US006042406A

United States Patent [19]

Marion

[11] Patent Number: 6,042,406

[45] Date of Patent: Mar. 28, 2000

[54] DUAL BLADE BATTERY CLAMP CONNECTOR

[75] Inventor: Timothy Marion, Chicago, Ill.

[73] Assignee: Snap-On Technologies, Inc., Lincolnshire, Ill.

[21] Appl. No.: 09/300,852

[22] Filed: Apr. 28, 1999

[51] Int. Cl.[7] ..... H01R 11/00

[52] U.S. Cl. ..... 439/175; 439/504; 439/506; 439/755; 439/759

[58] Field of Search ..... 439/174, 175, 439/504, 506, 755, 759, 856, 857

[56] References Cited

U.S. PATENT DOCUMENTS 4,345,807 8/1982 Shekel et al. .
4,565,414 1/1986 French .
4,620,767 11/1986 Woolf .
4,923,415 5/1990 Lee .
4,975,089 12/1990 Lee .
5,026,307 6/1991 Lee .
5,662,504 9/1997 Krivec .

*Primary Examiner*—Stanley J. Witkowski
*Attorney, Agent, or Firm*—McDermott, Will & Emery

[57] ABSTRACT

A battery terminal clamp for attachment to batteries having either top or side mounted battery terminal posts includes a housing, a dual-clamp connector disposed within the housing, and a clamp selector operatively coupled to the dual-clamp connector. The dual-clamp connector includes first and second clamps positioned at opposite ends of the housing, and a current exchange terminal in between. The first clamp is configured for engaging a first type of battery terminal post, and the second clamp is configured for engaging a second type of battery terminal post. The clamp selector can be selectively set to either a first or second position. The first position exposes only the first clamp, while the second position exposes only the second clamp.

20 Claims, 4 Drawing Sheets

DUAL BLADE BATTERY CLAMP CONNECTOR

BACKGROUND OF THE INVENTION

1. Field of the Invention

The present invention relates to electrical connectors and, more particularly, to an electrical connector for use with vehicle batteries.

2. Description of the Related Art

Persuasive use of automobiles has led to the enactment of numerous regulations concerning their safety and efficiency. For example, automobiles are required to incorporate various space-consuming safety features such as seatbelts and airbags to protect passengers during a collision. Manufacturers have addressed these requirements, in part, by constructing automobiles that incorporate compact engine compartments that do not sacrifice cabin space. The resulting engine compartment is often cramped, with minimal spacing between components. One such component is the battery used to start the automobile.

One problem that commonly affects motorists is a discharged battery which prevents the automobile from starting. Although a discharged battery can result from various conditions, such an event typically occurs when a motorist exits the car without verifying that certain electrical components (i.e., headlamps) have been shut off. Upon returning, the motorist is unable to start the automobile because an excessive quantity of current has been drained from the battery. Consequently, an auxiliary source of current, or a new battery, must be provided in order to start the automobile.

The most common method of starting an automobile having a discharged battery is to provide a "jump" to the automobile that has the discharged battery using a set of cables (i.e., jumper cables) connected to an external battery such as a portable emergency battery or the battery of a second automobile. Jumper cables include clamps at each end that are attachable to the terminals of an automobile battery. Once properly connected, the discharged battery draws current from the external battery in order to start the engine. Alternatively, the discharged battery may be charged using an appropriate charging unit. Regardless of the method used, however, a cable having a compatible clamp is generally required for attachment to the terminals of the discharged battery.

An automobile battery typically consists of terminal posts on top of the battery. Recent trends in engine compartment configuration have necessitated batteries that incorporate side mounted terminal posts. Side mounted terminal posts, however, are often sized smaller than top mounted terminal posts. Furthermore, side mounted terminal posts are often positioned relatively close to other components of the automobile. Consequently, it is very difficult to connect a standard jumper cable clamp (which is often very large) to side mounted battery terminal posts when providing a jump, resulting in a frustrating experience for stranded motorists. In addition, the probability of improperly connecting the clamps and causing injury to the motorist is significantly increased, particularly at night. For example, a common problem experienced when using standard jumper cable clamps with side mounted battery terminal posts is unintentional disconnection of the clamp as a result of the difference in size between the clamps and the side mounted terminal post. The disconnected clamp can hit various components in the engine compartment, causing arcing and possibly resulting in damage to the component or injury to the driver.

One attempt at addressing the difficulties encountered when connecting a jumper cable clamp to the side mounted terminal post of a battery requires securing an adapter to the clamp. Such adapters, however, do not reduce the size of the clamp and, consequently do not reduce the probability of causing inadvertent contact between the clamp and adjacent components when the adapter is being connected to the side mounted terminal post. In addition, such adapters often require complicated assemblies to facilitate attachment to the clamp.

DISCLOSURE OF THE INVENTION

There exists a need for a battery terminal clamp that is capable of being attached to either top or side mounted terminal posts without the use of complex adapters, and this and other needs are addressed by the present invention wherein a battery terminal clamp includes a dual-clamp connector having first and second clamps that may be selectively exposed for attachment to top or side mounted battery terminal posts.

In accordance with one aspect of the invention, a battery terminal clamp includes a housing, a dual-clamp connector, and a clamp selector. The housing includes at least one opening, and the dual-clamp connector is disposed within the housing. The dual-clamp connector includes a first clamp positioned at one end of the housing, a second clamp positioned at a second end opposite the first, and a current exchange terminal. The first clamp is configured for engaging a first type of battery terminal post, and the second is configured for engaging a second type of terminal post. The current exchange terminal, positioned between the first and second ends of the dual-clamp connector, allows attachment of a current-conducting cable. The clamp selector, operatively coupled to the dual-clamp connector, can be selectively set to a first or second position. The first position exposes the first clamp, while the second position exposes the second clamp. The novel terminal clamp eliminates the need for complex adapter assemblies that must be fitted to existing battery terminal clamps. This is accomplished using a dual-clamp connector that selectively exposes one of two clamps that are specifically designed to engage either top mounted or side mounted battery terminal posts. Accordingly, connection to various types of battery terminal posts is simplified.

Additional advantages and novel features of the present invention will be set forth in part in the description which follows, and in part will become apparent to those skilled in the art upon examination of the following, or may be learned by practice of the invention. The advantages of the invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designations represent like elements throughout and wherein.

DETAILED DESCRIPTION OF ILLUSTRATIVE EMBODIMENTS

Figure 1:
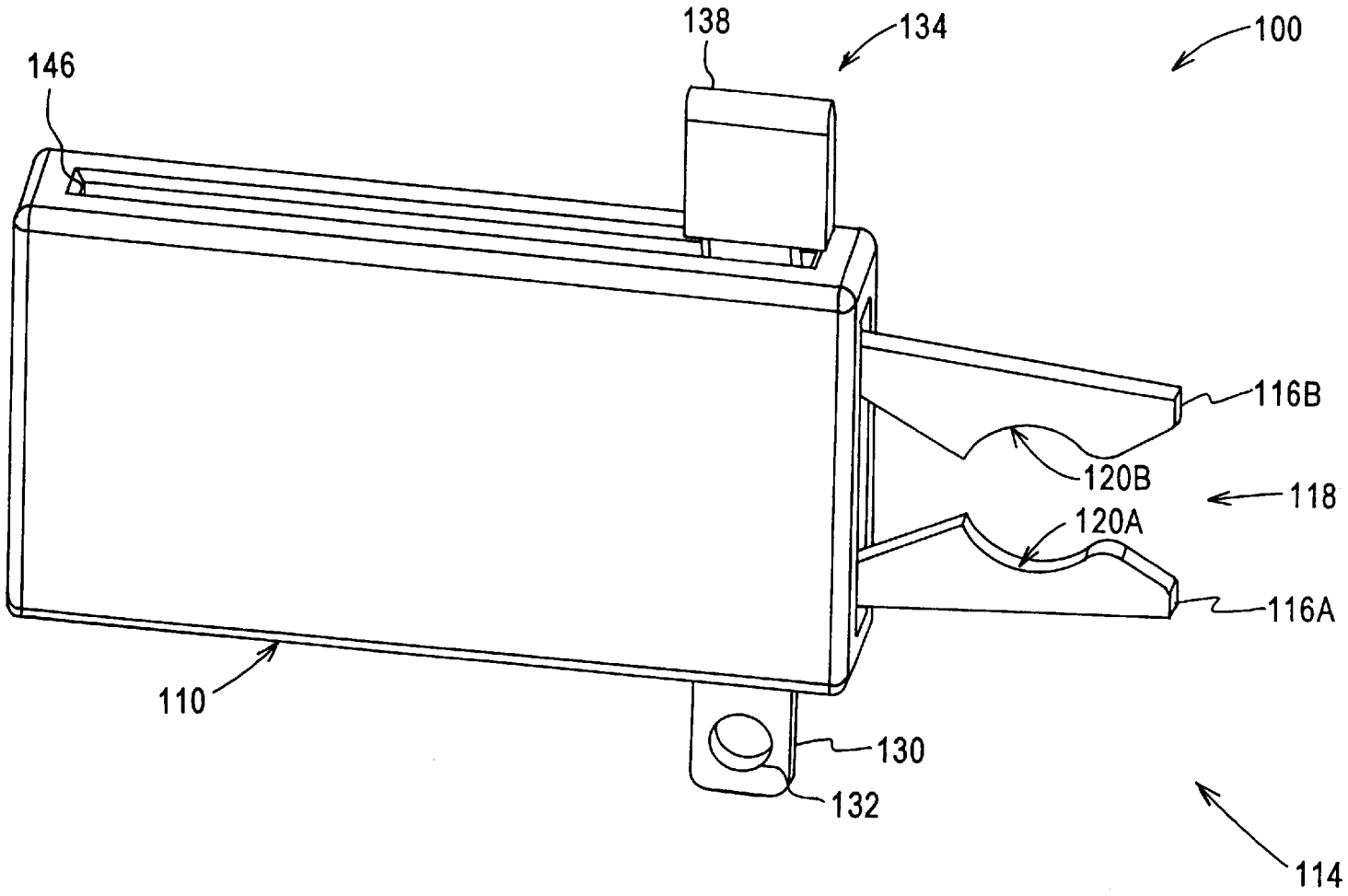
FIG. 1 is a perspective view of a battery terminal clamp constructed in accordance with one embodiment of the present invention.

Referring to FIG. 1, there is shown a battery terminal clamp 100 constructed in accordance with an exemplary embodiment of the present invention. The battery terminal clamp 100 includes a housing 110 that has a generally rectangular configuration, although a variety of other functional configurations can be provided. The housing 110 is preferably of a length greater than its height. The housing 110 includes two side surfaces that define the housing height. Each side surface contains an opening 150 (only one shown) having a prescribed width. The opening 150 will be described in greater detail later. The housing 110 is preferably constructed of an insulating material to facilitate handling, and minimize accidental electrical shock to an operator. Alternatively, the housing 110 can be covered with a layer (not shown) of insulating material.

Figure 2:
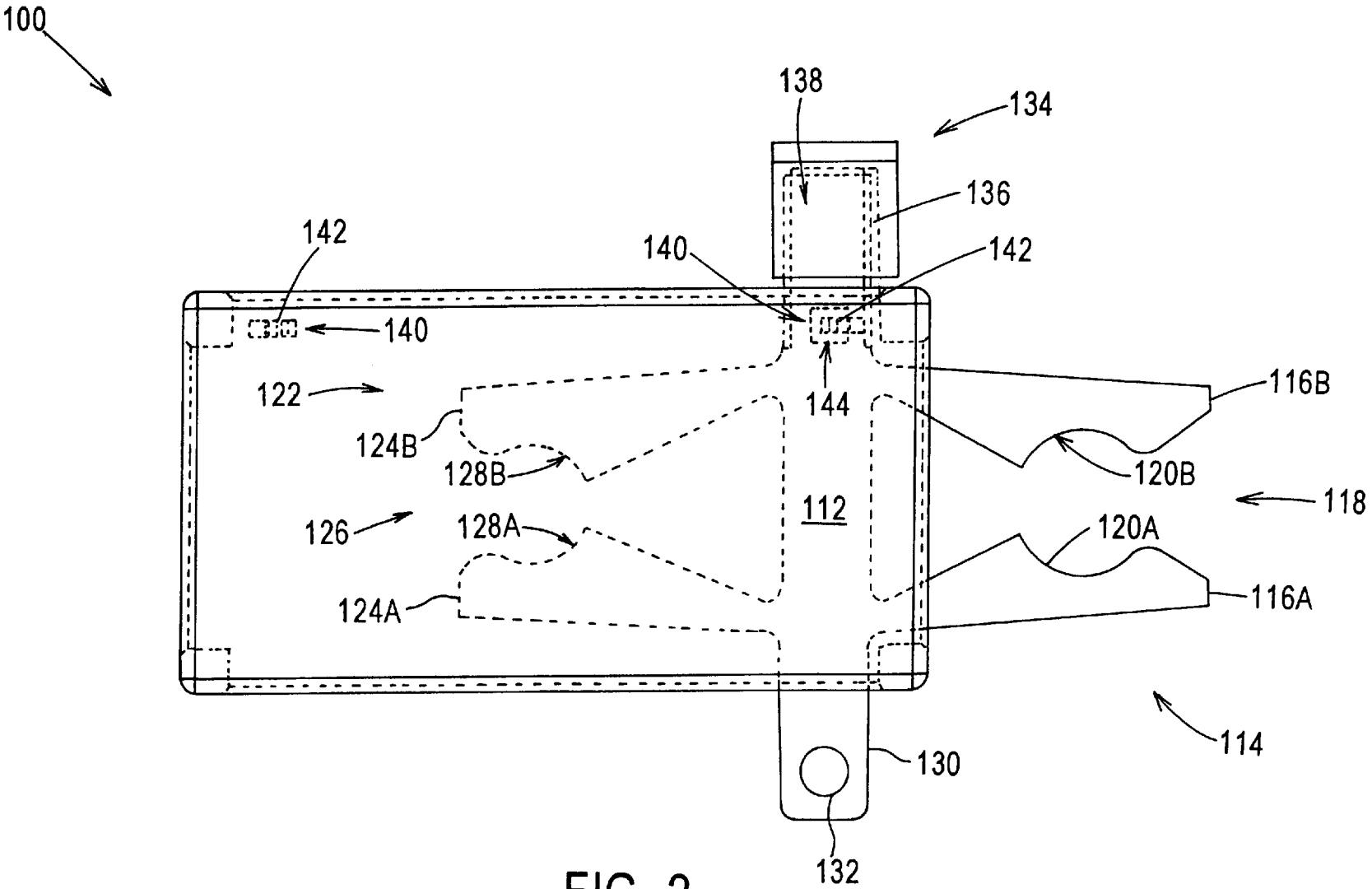
FIG. 2 is a side elevational view of the battery terminal clamp of FIG. 1.

With continued reference to FIG. 1 and additional reference to FIG. 2, the battery terminal clamp 100 includes a dual-clamp connector 112 that is disposed within the housing 110. One end of the dual-clamp connector 112 has a first clamp 114, and the opposite end has a second clamp 122. The first and second clamps 114, 122 are respectively configured for lengaging first and second types of battery terminal posts. According to the disclosed embodiment of the invention, the first type battery terminal post corresponds to a top mounted battery terminal post, while the second type battery terminal post corresponds to a side mounted battery terminal post. The first clamp 114 includes a first pair of jaws 116 (116A and 116B collectively) that define an opening 118 through which the first type battery terminal post can be received. Each jaw 116A, 116B includes a curved interior portion 120A, 120B that is sized and positioned to receive the first type battery terminal post. The first set of jaws 116 is constructed from appropriate material such that a closing bias is developed when the jaws are opened. This spring bias functions to secure the first clamp 114 to the first type battery terminal post, and generate sufficient surface contact for conducting the required amount of electrical current.

As illustrated in FIG. 2, the second clamp 122 includes a second set of jaws 124 that define a second opening 126 through which a second type battery terminal post can be received. Each jaw 124A, 124B of the second jaws 124 includes an interior curved portion 128A, 128B cooperatively positioned and sized for receiving the second type battery terminal post. Furthermore, the second set of jaws 124 is formed with the dual-clamp connector 112 such that a closing bias is developed to retain the jaws to the second type battery terminal post.

As illustrated in FIG. 1, the openings 150 formed in the side surfaces of the housing 110 to allow exposure of either the first clamp 114 or the second clamp 122. According to the disclosed embodiment of the invention, when the first clamp 114 is exposed through its corresponding opening 150 in the side wall of the housing 110, the second clamp 122 is contained entirely within the housing 110. Hence, the likelihood of the second clamp 122 contacting a metallic, or otherwise conductive surface, is reduced. Further, the risk of an operator contacting the exposed clamp is reduced.

The dual-clamp connector 112 also includes a current exchange terminal 130 that conducts a flow of current through the dual-clamp connector 112 between a source and destination pair of electrical terminals. For example, the current source may be an external charger that will be used to supply current to a discharged battery (i.e., the destination). Accordingly, the dual-clamp connector 112 is preferably constructed of a highly conductive material such as, for example, copper. The current exchange terminal 130, in the form of a projecting member that extends from the dual-clamp connector 112, is positioned between the first and second clamps 114, 122, although various other locations can be used. Furthermore, the current exchange terminal 130 contains an aperture 132 that is suited for receiving a cable (not shown), or other physical medium when current must be transferred. Once the cable is received within aperture 132, various fastening arrangements (i.e., welding, threaded fasteners, etc.) can be used to secure the cable to the current exchange terminal 130.

The battery terminal clamp 100 also includes a clamp selector 134 that is operatively coupled to the dual-clamp connector 112. The clamp selector 134 allows selective exposure of either the first clamp 114 or the second clamp 122 through the corresponding opening on the side wall of the housing 110. As illustrated in FIGS. 1 and 2, the clamp selector 134 includes a projecting member 136 that extends from the dual-clamp connector 112. A cap 138, or appropriate insulating cover, is disposed over the projecting member 136 to provide protection against electrical shock. As further illustrated in FIG. 1, the top surface of the housing 110 includes a first groove 146 that accommodates movement of the clamp selector 134. According to the disclosed embodiment of the invention, the clamp selector 134 functions as a slider switch. Hence, when slid to one end of the housing 110, the first clamp 114 is exposed. When slid, through the first groove 146, to the second end of the housing 110, the second clamp 122 is exposed.

Figure 3:
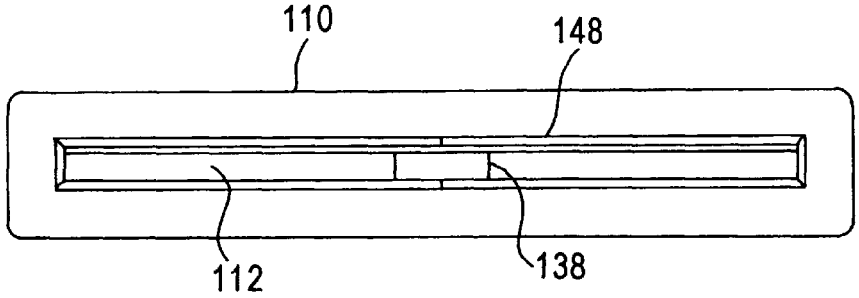
FIG. 3 is a bottom plan view of the battery terminal clamp of FIG. 1.

Referring additionally to FIG. 3, the bottom surface of the housing 110 also includes a second groove 148. The second groove 148 provides a conduit through which the current exchange terminal 130 can travel. According to the embodiment of the invention illustrated in FIG. 3, the second groove 148 is positioned in alignment with the first groove 146. Furthermore, the second groove 148 is sized such that movement of the clamp selector 134 between the first and second positions is not restricted by the current exchange terminal 130.

Figure 4:
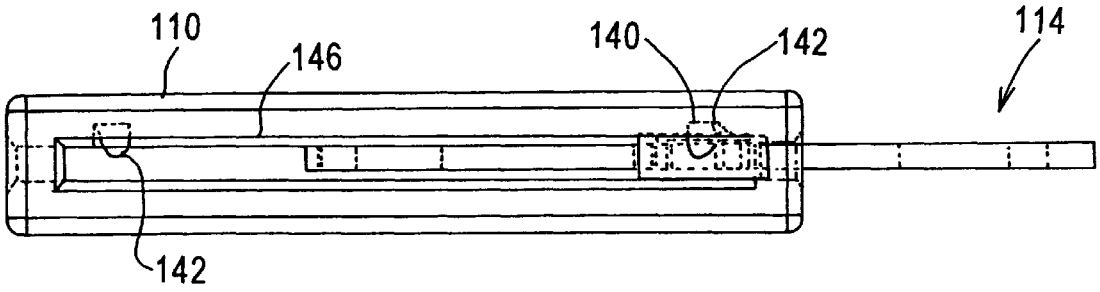
FIG. 4 is a top plan view of the battery terminal clamp illustrating a lock mechanism according to one embodiment of the present invention.

During normal operation, it is important that the dual-clamp connector 112 retain the position selected by the clamp selector 134. Accordingly, an appropriate arrangement must be provided to secure the dual-clamp connector 112 within a selected position. According to one embodiment of the present invention, a lock mechanism 140 is provided to retain the dual-clamp connector 112 within a selected position. Referring to FIGS. 2 and 4, the lock mechanism 140 includes a pair of latches 142 disposed at first and second ends of the housing 110. The dual-clamp connector 112 also includes an aperture 144 that extends through the projecting member 136 of the clamp selector 134. When the clamp selector 134 is moved to expose, for example, the first clamp 114, the aperture 144 will be positioned to receive the latch 142 located at the first end of the dual-clamp connector 112. According to the exemplary embodiment illustrated in FIGS. 2 and 4, the latches 142 include a preset spring bias that forces them into the aperture 144. For example, when the clamp selector 134 is moved to expose the first clamp 114, the projecting member 136 will act against the spring bias of the latch 142 to force the latch 142 into a depressed position. As the clamp selector 134 is moved to its final position, the spring bias in the latch 142 will force it to be inserted into the aperture 144. Hence, the dual-clamp connector 112 will be retained in the selected position.

Figure 5:
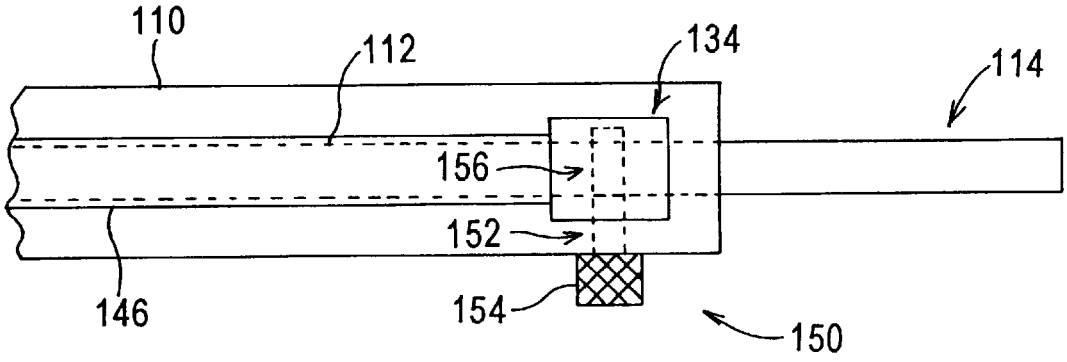
FIG. 5 is a partial top plan view illustrating a lock mechanism according to a second embodiment of the present invention.

FIG. 5 illustrates a second embodiment for a lock mechanism 150 that may be used to retain the dual-clamp connector 112 in a selected position. The housing 110 is provided with apertures 152 that are positioned at either end of the housing. The apertures 152, which replaces the latches 142 illustrated in FIG. 2, extend through one side of the housing 110 and into the first groove 146. Furthermore, the projecting member 136 of the clamp selector 134 also includes an aperture 156 that is positioned for alignment with the apertures 152 in the housing 110 when the clamp selector 134 is placed in either the first or second position. A threaded fastener 154, such as a screw, is then inserted through the aperture 152 in the housing 110 and into the aperture 156 of the projecting member 136. According to such an arrangement, the aperture 152 in the housing 110 can include appropriate threading for receiving the threaded fastener 154. Once the threaded fastener 154 is appropriately inserted, the dual-clamp connector 112 will be prevented from moving out of the selected position. The housing can also be provided with a recess (not shown) that is aligned with each aperture 152 contained therein. The recess functions to receive the terminal end of the threaded fastener 154 in order to provide additional rigidity when retaining the dual-clamp connector 112. Alternatively, the threaded fastener 154 may be inserted until its terminal end abuts the internal wall of the housing 110. It should be further noted that various other types of lock mechanisms, such as a spring loaded rivet or plunger (not shown), can be used in place of the threaded fastener 154. For example, such an arrangement can include a spring having a predetermined preload and be attached both to the housing and the plunger. The preload is sufficient for retaining the plunger within aperture 156 of projecting member 136 to thereby retain the dual-clamp connector 112 within a selected position. The plunger is then moved (i.e., acting against the spring force) to allow selection of a different position for the dual-clamp connector 112.

Figure 6:
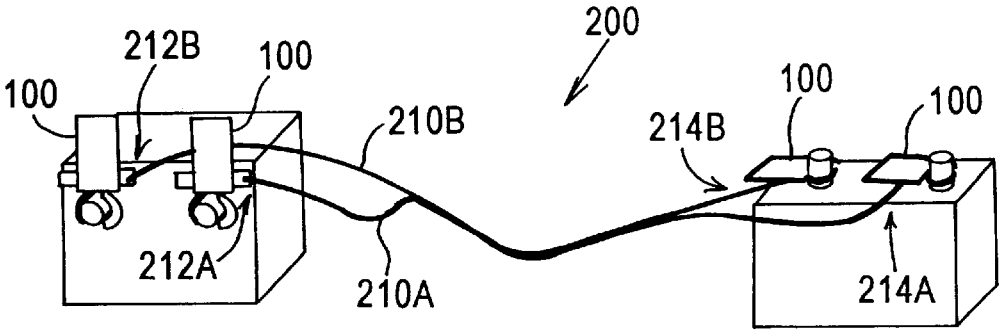
FIG. 6 is block diagram illustrating a jumper cable set constructed in accordance with the present invention.

The present invention finds utility in numerous applications, particularly in the automotive industry where motorists often return to an automobile only to discover that the battery has been discharged, hence, resulting in a condition where the automobile cannot be started. Referring to FIG. 6, a jumper cable set 200 that incorporates a battery terminal clamp 100 according to an embodiment of the present invention is illustrated. The jumper cable set 200 includes a pair of electrically conductive cables 210A, 210B (collectively 210) that are designed to conduct a prescribed quantity of electrical current. For example, the prescribed quantity of electrical current can be an amount sufficient to provide a jump to (i.e., start) a disabled vehicle. Each individual cable 210A, 210B includes a first end 212A, 212B and a second end 214A, 214B. Furthermore, the pair of cables 210 can be correspondingly designated as positive (+) and negative (−) for appropriate connection to an electrical terminal. According to one embodiment of the present invention, the first end 212 of the jumper cable set 210 can be permanently attached to a battery charging unit (not shown) that operates on standard AC current source such as, for example, a wall outlet in a home. Such an embodiment is useful for trickle charging a discharged battery over an extended period of time.

As further illustrated in FIG. 6, a battery terminal clamp 100 is attached to each end 212, 214 of the cables 210 that comprise the jumper cable set 200. The battery terminal clamps 100 are constructed in the manner previously described, and therefore allow selection of either a first or second clamp 114, 122 for connection to a battery terminal post. Selection of the clamp is dictated by the type of battery to which the jumper cable set 200 will be attached. For example, if the battery contains top mounted terminal posts, then the first clamp 114 is selected. Otherwise, the second clamp 122 is selected for side mounted terminal posts. Since each battery terminal clamp can be individually set to either a top mounted terminal post or side mounted terminal post, any combination of batteries can be used with the jumper cable set 200 of the present invention. This is illustrated in FIG. 6 wherein the first end 212 of the jumper cable set 200 is connected to side mounted terminal posts, and the second end 214 of the jumper cable set 200 is connected to top mounted terminal posts.

Once the proper clamps have been selected for the particular batteries available, the jumper cable set 200 is appropriately connected to the battery terminals and a jump is provided from a charged battery to the discharged battery. The general procedure for providing a jump is well known. Typically, a charged battery that is operationally disposed in a first automobile is designated as the source, while the discharged battery (located in a second automobile) is designated as the recipient. The first automobile is started in order to initiate a charging system, such as an alternator, that is electrically connected to the battery. Next, the jumper cable set 200 is connected to the terminals of the source and destination batteries according to a predetermine sequence that can, for example, be described on one of the batteries. For example, one sequence requires: (1) connecting the first end 212A of the negative cable 210A to the negative terminal of the source battery, (2) connecting the second end 214A of the negative cable 210A to the negative terminal of the destination battery, (3) connecting the first end 212B of the positive cable 210B to the positive terminal of the source battery, and (4) connecting the second end 214B of the positive cable 210B to the positive terminal of the destination battery. Once the jumper cable set 200 is appropriately connected, the second automobile can be started.

The present invention advantageously provides a battery terminal clamp that can be quickly and conveniently configured for attachment to either top or side mounted battery terminal posts without the use of complex adapters. This is accomplished through the use of a battery terminal clamp that includes a dual-clamp connector having first and second clamps that can be selectively exposed for attachment to either top or side battery terminal posts. Furthermore, the battery terminal clamp of the present invention is readily configurable for attachment to appropriate cables for use as a jumper cable set. One advantage of such a battery terminal clamp is that complex adapters do not need to be attached to standard jumper cables when side mounted battery terminal posts must be accessed, thereby reducing the size of the clamp and facilitating easy access to tightly spaced battery terminals.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A battery terminal clamp comprising:

a housing including at least one opening therein;

a dual-clamp connector disposed within said housing, said dual-clamp connector including:

a first clamp configured for engaging a first type battery terminal post, a second clamp configured for engaging a second type battery terminal post, and a current exchange terminal for connecting a cable to said dual-clamp connector; and a clamp selector operatively coupled to said dual-clamp connector for selectively exposing either said first clamp or said second clamp through one of said at least one opening when the selector is placed in a first position or a second position, respectively;

wherein said exposed clamp can engage the first or second type battery terminal post.

2. The battery terminal clamp of claim 1, wherein said housing has a generally rectangular configuration of a length greater than its width, and wherein a side corresponding to the width of said housing contains one of said openings.

3. The battery terminal clamp of claim 1, wherein said housing is formed from a thermoplastic material.

4. The battery terminal clamp of claim 1, wherein said first clamp includes a first pair of jaws containing first inner curved surfaces cooperatively positioned and sized for receiving said first type battery terminal post.

5. The battery terminal clamp of claim 1, wherein said second clamp includes a second pair of jaws containing second inner curved surfaces cooperatively positioned and sized for receiving said second type battery terminal post.

6. The battery terminal clamp of claim 1, wherein said first clamp is positioned at a first end of said dual-clamp connector and said second clamp is positioned at second opposite end of said dual-clamp connector.

7. The battery terminal clamp of claim 1, wherein said current exchange terminal is positioned between said first and second ends of said dual-clamp connector.

8. The battery terminal clamp of claim 1, wherein said housing includes a third opening along the housing length, and said current exchange terminal comprises a projecting member extending from said dual-clamp connector and through said third opening.

9. The battery terminal clamp of claim 1, wherein said housing includes a fourth opening along the housing length, and said clamp selector includes a second projecting member extending from said dual-clamp connector and through said fourth opening.

10. The battery terminal clamp of claim 1, wherein said first type battery terminal post is a top mounted battery terminal post, and said second type battery post is a side mounted battery terminal post.

11. The battery terminal clamp of claim 1, wherein said dual-clamp connector is formed from a conductive material.

12. The battery terminal clamp of claim 11, wherein said conductive material comprises copper.

13. The battery terminal clamp of claim 1, further comprising a locking mechanism for locking said clamp selector in said first and second positions.

14. The battery terminal clamp of claim 13, wherein said dual-clamp connector includes an aperture, and said locking mechanism includes at least one latch for engaging said aperture and locking said dual-clamp connector in either said first or second position.

15. The battery terminal clamp of claim 13, wherein said dual-clamp connector includes an aperture, and said locking mechanism includes at least one connector capable of being inserted through a corresponding aperture in said housing and into the aperture in said dual-clamp connector for locking said dual-clamp connector in either said first or second position.

16. The battery terminal clamp of claim 15, wherein said connector is a threaded fastener.

17. The battery terminal clamp of claim 15, wherein said connector is a spring loaded rivet.

18. A jumper cable set comprising:

a pair of electrically conductive cables having a prescribed current conducting capacity, each said electrically conductive cables having a first end and a second end; and a battery terminal clamp attachable to each end of said electrically conductive cables, said battery terminal clamp including:

a housing including at least two openings therein;

a dual-clamp connector disposed within said housing, said dual-clamp connector including:

a first clamp positioned at a first end of the connector and configured for engaging a first type battery terminal post, a second clamp positioned at a second, opposite end of the connector and configured for engaging a second type battery terminal post, and a current exchange terminal positioned between said first and second ends of said dual-clamp connector for connecting said battery terminal clamp to a corresponding end of said electrically conductive cables; and a clamp selector operatively coupled to said dual-clamp connector for selectively exposing either said first clamp or said second clamp through one of said at least two openings when the selector is placed in a first position or a second position, respectively;

said exposed clamp being connectable to either the first or second type battery terminal post.

19. An arrangement for transferring charge to a discharged battery, comprising:

a charging unit;

a jumper cable set having a first pair of ends attachable to said charging unit, and a second pair of ends attachable to the discharged battery; and a battery terminal clamp attached to each end of said jumper cable set, said battery terminal clamp including:

a housing including at least two openings therein;

a dual-clamp connector disposed within said housing, said dual-clamp connector including:

a first clamp positioned at a first end of the connector and configured for engaging a first type battery terminal post, a second clamp positioned at a second, opposite end of the connector and configured for engaging a second type battery terminal post, and a current exchange terminal positioned between said first and second ends of said dual-clamp connector for connecting said battery terminal clamp to a corresponding end of said electrically conductive cables; and a clamp selector operatively coupled to said dual-clamp connector for selectively exposing either said first clamp or said second clamp through one of said at least two openings when placed in a first position or a second position, respectively;

said exposed clamp being connectable to the first or second type battery terminal post.

20. The arrangement of claim 19, wherein said charging unit is a battery charger.

* * * * *